US006619655B2

(12) United States Patent
Müller et al.

(10) Patent No.: US 6,619,655 B2
(45) Date of Patent: Sep. 16, 2003

(54) APPARATUS FOR FEEDING SHEETS AND METHOD OF DETERMINING THE VERTICAL POSITION OF STACKED SHEETS

(75) Inventors: Tobias Müller, Hirschberg (DE); Thomas Wolf, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 29 days.

(21) Appl. No.: 09/940,091

(22) Filed: Aug. 27, 2001

(65) Prior Publication Data

US 2002/0060393 A1 May 23, 2002

(30) Foreign Application Priority Data

Aug. 25, 2000 (DE) ..... 100 41 909

(51) Int. Cl.[7] ..... B65H 1/18
(52) U.S. Cl. ..... 271/152
(58) Field of Search ..... 399/1–200, 201–411; 347/201–263; 101/251–494; 400/411; 271/152, 25, 31, 38, 130, 179, 194, 215

(56) References Cited

U.S. PATENT DOCUMENTS 4,196,898 A * 4/1980 Misawa et al. ..... 271/9.08
5,263,704 A * 11/1993 Kruger ..... 271/217
6,053,485 A * 4/2000 Pan et al. ..... 261/114.4

FOREIGN PATENT DOCUMENTS

JP 58-31841 * 2/1983 ..... B65H/7/06

* cited by examiner

*Primary Examiner*—Donald P. Walsh
*Assistant Examiner*—Kenneth W Bower
(74) *Attorney, Agent, or Firm*—Laurence A. Greenberg; Werner H. Stemer; Ralph E. Locher

(57) ABSTRACT

An apparatus for feeding sheets from a stack to a machine that processes the sheets and a method of determining the vertical position of stacked sheets. The method enables the vertical position of the topmost sheet resting on the sheet stack to be determined using a sensor device. Ultrasonic pulses are applied to a longitudinal side of the sheet stack such that the pulses strike the longitudinal side of the stack at an angle, and the position of the upper edge of the stack is determined by means of an ultrasonic propagation time measurement.

26 Claims, 2 Drawing Sheets

APPARATUS FOR FEEDING SHEETS AND METHOD OF DETERMINING THE VERTICAL POSITION OF STACKED SHEETS

BACKGROUND OF THE INVENTION

Field of the Invention

The invention relates to an apparatus for feeding sheets from a stack to a sheet-processing machine and to a method of determining the vertical position of stacked sheets using a sensor device.

Apparatuses for feeding sheets from a stack to a sheet-processing machine, for example, to a sheet-fed printing machine are known. In order to be able to ensure the exact and fault-free feeding of the sheets, the vertical position of the sheet stack, which can be moved vertically, must be set exactly within close limits. In order to determine the vertical position of the topmost sheet lying on the stack, Published German Patent Application DE-A 17 86 008 discloses a sheet feeding apparatus that uses a mechanical sensing device, which senses the top of the stack, and a photo electric sensing device. These optical sensors have the disadvantage that they are very sensitive to dirt and therefore are only reliable to a certain extent. In addition, fluttering sheets, which occur when air is blown under the topmost sheet in order to loosen the sheet stack, lead to inaccurate measurement. The optical sensors also have the disadvantage that, because of their overall height, they cannot be used in every case. A further disadvantage is the unreliability of optical sensors when using exotic printing materials, such as transparent, black or metallic printing materials.

SUMMARY OF THE INVENTION

It is accordingly an object of the invention to provide an apparatus and a method for determining the position of the sheet stack which overcomes the above-mentioned disadvantageous of the prior art apparatus and methods of this general type. In particular, it is an object of the invention to provide such an apparatus and a method with which the vertical position of the sheet stack can be determined and then set very exactly and with high reliability.

With the foregoing and other objects in view there is provided, in accordance with the invention, an apparatus for feeding sheets from a stack to a sheet processing machine, in which the apparatus includes a sensor device for determining the position of the topmost sheet lying on the stack. The sensor device for determining the vertical position of the topmost sheet lying on the stack includes at least one ultrasonic sensor. This ultrasonic sensor transmits ultrasonic pulses which are directed onto the sheet stack and are reflected as an echo to a sensor belonging to the ultrasonic sensor. Using an additional device, an ultrasonic propagation time measurement is carried out, and the result of an evaluation is transmitted to a control unit, which drives a vertical adjusting device for the sheet stack in order to raise and lower the latter. Using the ultrasonic sensor, very accurate and reliable determination of the vertical position of the sheet stack is possible, so that the latter can be tracked, cyclically or continuously, in such a way that the topmost sheet on the stack can be aligned in the desired manner opposite a transport element used for the onward transport of the sheets to be separated. High functional reliability for the feed apparatus can therefore be ensured. The ultrasonic sensor is considerably less sensitive to dirt than known optical sensors. In addition, it is advantageous that a compact, preferably miniaturized ultrasonic sensor can be used, which can be arranged at virtually any point around the sheet stack. A further advantage is that the sensor has the same sensitivity to all grades of printing material.

In accordance with an added feature of the invention, the ultrasonic sensor is arranged below the upper edge of the stack, that is to say the ultrasonic pulses emitted by the sensor strike at least one of the ends of the sheet stack at an angle. This permits the evaluation of the differential propagation times of the echo reflected from the sheet stack and, if necessary, from the outgoing sheet or another reference point.

In accordance with an additional feature of the invention, the ultrasonic sensor is arranged in front of the side of the stack that faces the sheet-processing machine. The ultrasonic sensor is therefore associated with the leading area of the sheet stack—as viewed in the transport direction of the sheets—and applies ultrasonic pulses to the leading edges of the sheets. In this case, therefore, the vertical adjustment of the sheet stack is performed as a function of the determined position of the upper edge of the stack at the leading edges of the sheets. As a result, exact and reproducible alignment of the topmost sheet on the stack with respect to the transport element used for the onward transport is possible.

With the foregoing and other objects in view there is also provided, in accordance with the invention, a method of determining the vertical position of stacked sheets, which includes the following steps: providing a sheet stack having a longitudinal side; providing ultrasonic pulses that strike the longitudinal side of the stack at an angle; and performing an ultrasonic propagation time measurement to determine a position of an upper edge of the stack.

The method, which is possible because of the specific spatial arrangement of the at least one ultrasonic sensor opposite the sheet stack, is distinguished by high functional reliability and accuracy. Exact measurement of the vertical position of the topmost sheet of the stack can be ensured even during a fluttering movement of the sheet when, for example, the topmost sheet is being loosened with the aid of a gaseous medium, that is to say it is being lifted off the sheet stack. This applies irrespective of the reflectance of the sheet or of the sheet material. This means that the method can be used universally, for example for paper sheets, transparent films, metallic or metallised sheets.

In accordance with an added mode of the invention, the differential propagation times between the echo from the sheet leaving the stack and the echo from the topmost sheet lying on the stack are evaluated. The ultrasonic pulse or the ultrasonic pulse train that is transmitted by the ultrasonic sensor runs from below against the stack and against the sheet that is being lifted off the stack and transported onward in the direction of the machine, and the pulse or pulse train is reflected. A large echo is reflected from the outgoing sheet, and many small echoes are reflected from the leading edges of the stacked sheets and these reflected echoes are obtained by the receiver belonging to the ultrasonic sensor. The echo arriving last at the receiver is that from the topmost sheet which, as compared with the other small echoes, which originate from the sheets located below it on the stack, has the longest path. It is therefore readily possible to distinguish between the echoes from the outgoing sheet, the topmost sheet on the stack, and the remaining stacked sheets. The position of the topmost sheet lying on the stack that has been determined in this manner is compared with a desired vertical position of the sheet stack. In the event of any violation of an upper or lower limit, the sheet stack is moved vertically into a desired position with the aid of a vertical adjusting device, which is driven by a control unit.

In accordance with an additional mode of the invention, the differential propagation times between the echo from the topmost sheet on the stack and the echo from a fixed reference point are determined. The reference point, located within the feeder, can be formed, for example, by a reference web on a flat shaft which is used to align the leading edges of the sheets and to guide the sheets. Here too, because of the specific spatial arrangement of the ultrasonic sensor opposite the sheet stack, the ultrasonic pulses that are transmitted by the at least one ultrasonic sensor run both against the reference point and against the stack, and are reflected and passed as an echo to the receiver. The echo returned from the reference point is more powerful than the many small echoes which are generated by the sheet stack or by the leading edges of the stacked sheets.

In accordance with another mode of the invention, the differential propagation times between the echo from the topmost, loosened sheet, and the echo from the remaining sheet stack located underneath the loosened sheet are evaluated. Loosening of the topmost sheet is carried out with the aid of a gaseous medium or, if appropriate, by means of a mechanical device, as a result of which the topmost sheet executes a fluttering movement. The sheets located underneath it are at the same time, at least substantially, properly stacked. This mode and the immediately previously mentioned mode of the method permit the continuous determination of the vertical position of the topmost sheet of the stack, since, in order to evaluate the differential propagation times, an outgoing sheet, that is to say one lifted off the sheet stack and already partially transported away from the stack in the direction of the machine, is not needed for this purpose.

With the foregoing and other objects in view there is also provided, in accordance with the invention, a method of determining the vertical position of stacked sheets, which includes the following steps: providing a sheet stack having a longitudinal side; from a plurality of locations, transmitting and focusing ultrasonic pulses at point on the longitudinal side of the stack; and controlling the transmitted ultrasonic pulses such that the point, at which the transmitted ultrasonic pulses focus, is moved along the longitudinal side of the stack. As a result of the focussing of the ultrasonic pulses, very good signal quality with high intensity can be implemented, which improves the functional reliability and the accuracy of the stack vertical position determination.

In accordance with a further mode of the invention, provision is made for the focus of the sound to be moved in a line at right angles to the leading edges of the stacked sheets. In this case, a scanning plane is scanned in which the leading edges of the stacked sheets are preferably arranged. The scanning plane is therefore, so to speak, scanned until the topmost point of the stack has been found. The displacement of the focus, that is to say the distance which the focus of the sound has traced, permits the inference and therefore the determination of the actual position of the topmost sheet of the stack relative to a desired intended vertical position of the stack, for example relative to a transport element for the onward transport of the sheets into the machine.

Other features which are considered as characteristic for the invention are set forth in the appended claims.

Although the invention is illustrated and described herein as embodied in an apparatus for feeding sheets, and method of controlling the vertical position of stacked sheets, it is nevertheless not intended to be limited to the details shown, since various modifications and structural changes may be made therein without departing from the spirit of the invention and within the scope and range of equivalents of the claims.

DESCRIPTION OF THE PREFERRED EMBODIMENTS

Figure 1:
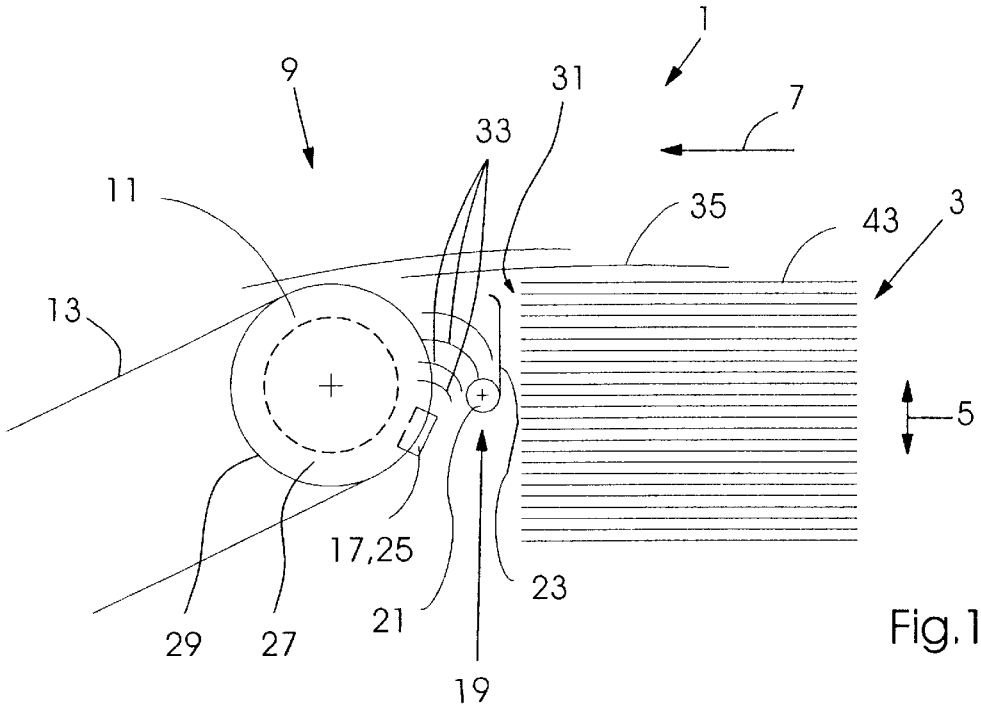
FIG. 1 is in a schematic illustration showing a feeder of a sheet-processing machine in which the feeder includes a first exemplary embodiment of a feed apparatus.

Referring now to the figures of the drawing in detail and first, particularly, to FIG. 1 thereof, there is shown a schematic illustration of a detail of a feeder 1 of a sheet-processing machine, for example a sheet-fed printing machine, which is not specifically illustrated. Arranged in the feeder, 1 is a sheet stack 3 which can be displaced in the vertical direction, in the direction of a double arrow 5, with the aid of a vertical adjusting device (not illustrated). With the aid of a separating device, not illustrated, the respective topmost sheet lying on the sheet stack 3 is lifted, and with the aid of a feed apparatus 9 arranged downstream of the sheet stack 3 in the sheet transport direction 7, the topmost sheet is transported onward in the direction of the machine.

The feed apparatus 9 includes a pull-in roll 11, over which a transport belt 13 is led, a functional part serving as an aligning and guide element, and also a sensor device 17.

The functional part is arranged in the free space between the sheet stack 3 and the pull-in roll 11 and is formed by a flap shaft 19, which can be pivoted about an axis 21 running at right angles to the plane of FIG. 1. The flap shaft 19 has a stop face 23, which can be displaced against the leading edges of the stacked sheet, in order to align the top area of the sheet stack. The function of the flap shaft 19 is known, so that it will not be discussed specifically here.

The sensor device 17 has at least one ultrasonic sensor 25 which, in this exemplary embodiment, is arranged in a recess 27 in the cover 29 of the pull-in roll 11. The recess 27 is formed circumferentially here. The arrangement of the ultrasonic sensor 25 within the recess 27 is selected in such a way that the sensor projects partially beyond the outer side of the pull-in roll 11. The ultrasonic sensor 25 is arranged below the upper edge of the stack and also below the axis 21 of the flap shaft 19, and is arranged opposite the long side 31 of the sheet stack 3 that faces the machine in such a way that the ultrasonic pulses 33 which it transmits run from below against the long side 31 of the sheet stack 3 and against the underside of the sheet 35 leaving the sheet stack 3.

Figure 2:
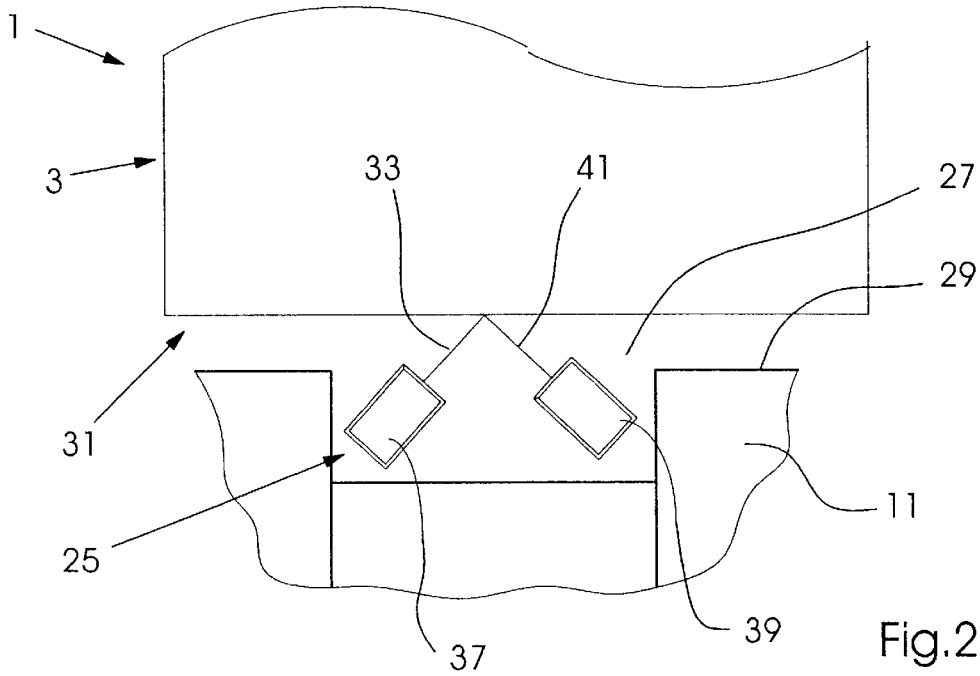
FIG. 2 is a plan view of a part of the feeder shown in FIG. 1.

FIG. 2 shows a plan view of the feeder 1 according to FIG. 1, in the area between the sheet stack 3 and the pull-in roll 11. It can be seen that the ultrasonic sensor 25 in this exemplary embodiment has an ultrasonic transmitter 37 and an ultrasonic receiver 39, both of which are arranged within the recess 27. The ultrasonic transmitter 37 is arranged opposite the sheet stack 3 in such a way that the echo 41, indicated by a line, of the ultrasonic pulse 33 striking the long side 31 of the stack is returned, that is to say reflected, substantially at right angles to the direction of the ultrasonic pulse 33. In a different exemplary embodiment, not illustrated, the ultrasonic sensor 25 merely has an ultrasonic transmitter which, after outputting an ultrasonic pulse, can be switched over to receive. The advantage here is that the recess 27 in the pull-in roll 11 only needs to have a small width for this purpose.

The feed apparatus 1 described using FIGS. 1 and 2 also has an additional device, preferably an electronic device, which is not illustrated but with the aid of which an ultrasonic propagation time measurement with evaluation of the differential propagation times between the echo from the sheet 35 leaving the sheet stack 3 and the echo from the topmost sheet 43 lying on the stack (FIG. 1) can be carried out. The additional device is connected to a control unit, for example a computer, to which the result from the evaluation of the differential propagation times, or respectively, a physical value for the amount by which the sheet stack 3 must be raised in the vertical direction in order to set a desired vertical position of the topmost sheet 43 of the sheet stack 3, is transmitted. The control unit then controls the vertical adjusting device for the sheet stack 3 appropriately, so that the sheet stack 3 is raised by a desired amount, so that the upper edge of the stack is located at a desired level opposite the flap shaft 19 or the pull-in roll 11.

The different propagation times between the echoes of the ultrasonic pulses 33 returned by the leading edges of the stacked sheets and that of the outgoing sheet 35 result from the arrangement and alignment of the ultrasonic sensor which—as stated—is arranged below the upper edge of the stack, in the area downstream of the sheet stack 3.

Figure 3:
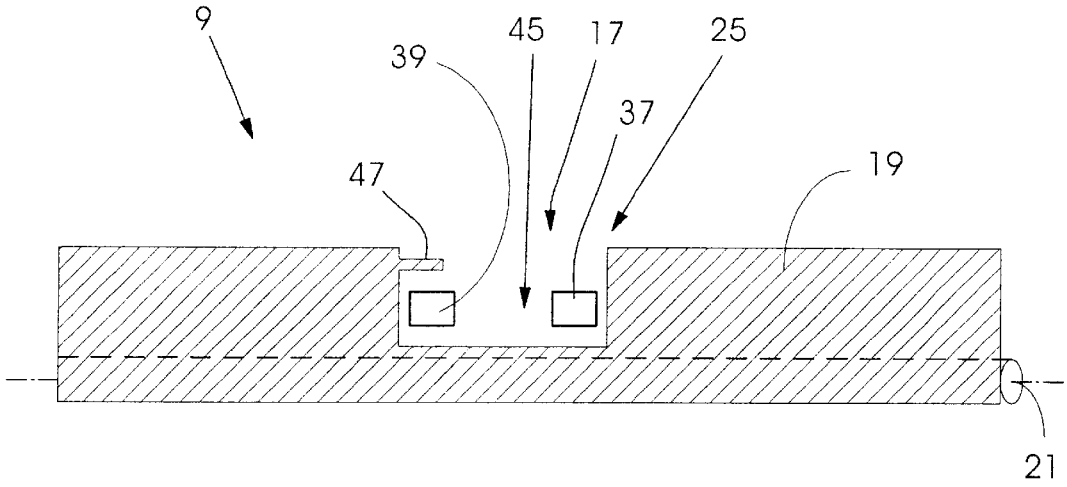
FIG. 3 shows a second exemplary embodiment of the feed apparatus with a second exemplary embodiment of a sensor device.

FIG. 3 shows a detail from a further exemplary embodiment of the feed apparatus 9 that has a further exemplary embodiment of the sensor device 17 with an ultrasonic sensor 25. Similar parts are provided with the same reference symbols, so that to this extent reference is made to the description relating to the preceding figures.

FIG. 3 shows a front view of the flap shaft 19 in the sheet transport direction 7. A cutout 45 has been introduced into the flap shaft 19, and reference web 47 projects into the cutout 45 of the flap shaft 19. The reference web 47 is connected in one-piece with the flap shaft 19. The ultrasonic transmitter 37 and the ultrasonic receiver 39 are located downstream of the flap shaft 19 in the sheet transport direction 7. The echo of the ultrasonic pulse reflected from the reference web 47 has a higher intensity and quality than the echo which is returned from the sheet 35 leaving the sheet stack and the leading edges of the stacked sheets. The echo returned to the ultrasonic receiver 39 from the reference web 47 can be distinguished from the others, and also because the flap shaft 19 is arranged in a fixed position within the feeder 1, the reference web has a fixed position. Now, by using a suitable additional device (not illustrated), an ultrasonic propagation time measurement can be carried out, in which an evaluation of the differential propagation times between the echo from the topmost sheet lying on the stack and the echo from the reference web is carried out.

The subject of the invention also includes a device for controlling the vertical position of a sheet stack, which has at least one ultrasonic sensor and an additional device for carrying out an ultrasonic propagation time measurement, as described using FIGS. 1 to 3.

Figure 4:
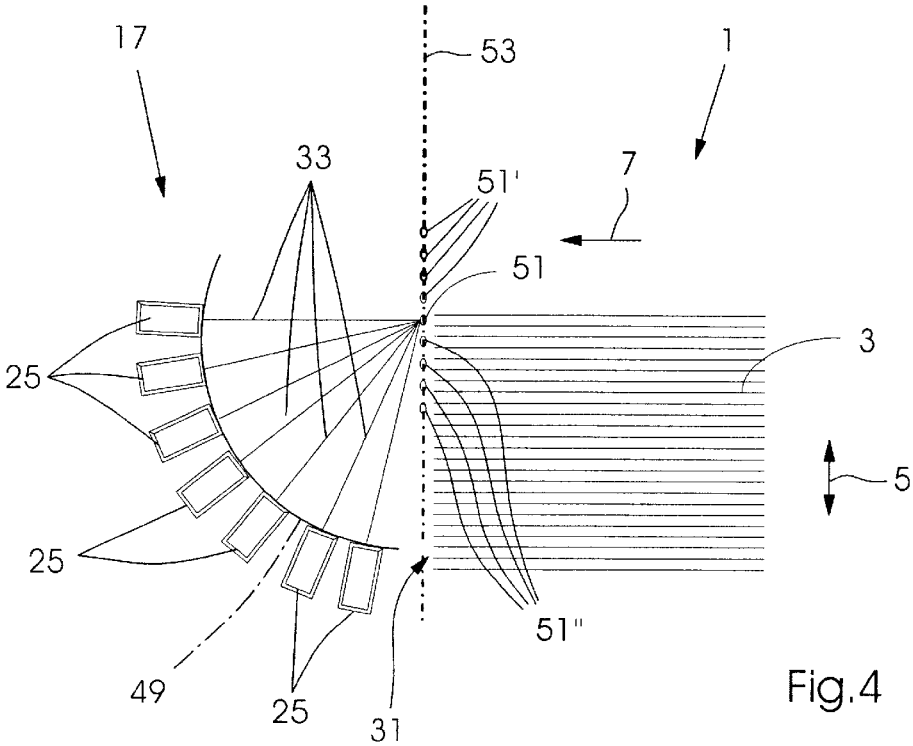
FIG. 4 shows a third exemplary embodiment of the feed apparatus having a third exemplary embodiment of the sensor device.

FIG. 4 shows a third exemplary embodiment of the sensor device 17. Parts which agree with those shown in the preceding figures are provided with the same reference symbols, so that to this extent, reference is made to the description relating to FIGS. 1 to 3. Here, the sensor device 17 has a total of six ultrasonic sensors 25, each of which can have a transmitter 37 and a receiver 35 or merely a transmitter which can be switched over to receive. The ultrasonic sensors 25, as viewed in the sheet transport direction, are arranged one above the other along an imaginary part-circle 49. In a different exemplary embodiment, not illustrated, the ultrasonic sensors 25 are arranged one beside the other in the sheet transport direction, that is to say in a plane which runs at right angles to the plane of FIG. 4. By driving the ultrasonic sensors 25 appropriately and in the correct phase, the ultrasonic pulses 33 can be focused at a focus 51 which is located in a scanning plane 53 that runs parallel to the long side 31 of the sheet stack 53. The leading edges of the stacked sheets preferably lie in the scanning plane 53. By changing the phase relationship between the transmitters of the ultrasonic sensors 25, the focus 51 can be moved in a line within the scanning plane 53, at right angles to the leading edges of the sheets, so that stack height detection is possible. Further scanning points 51', which are located above the upper edge of the stack, and foci 51", which are located below the upper edge of the stack, are indicated in FIG. 4. Because of the focusing of the ultrasonic pulses 33, their echo has a high intensity and signal quality, so that reliable detection of the topmost sheet of the sheet stack 3 is readily possible. Via the displacement of the focus, conclusions can be drawn about the actual position of the respective topmost sheet of the sheet stack 3 relative to a reference point, for example the pull-in roll 11 or the flap shaft 19. The focus is preferably displaced with the aid of an additional device, which is connected to the control unit which can actuate the vertical adjusting device for the sheet stack 3.

The method described above readily emerges from the description relating to FIGS. 1 to 4.

In summary, the sensor device 17, which has at least one ultrasonic sensor 25, permits very precise determination of the vertical position of the sheet stack 3. Only in this way can the alignment of the respective topmost sheet lying on the sheet stack 3 with respect to a transport element for the onward transport of the sheets to the following machine be performed so precisely. The at least one ultrasonic sensor 25 preferably has only a very low height, so that it can be arranged virtually anywhere within the feeder 1.

We claim:

1. An apparatus for feeding sheets in a stack to a sheet-processing machine, the stack having an upper edge and a longitudinal side facing the sheet-processing machine, the apparatus comprising:

at least one sensor device for determining a vertical position of a topmost sheet lying on the stack, said sensor device including at least one ultrasonic sensor disposed below the upper edge of the stack and in front of the longitudinal side of the stack, said ultrasonic sensor being configured to emit a sound pulse against a sheet leaving the stack and against the longitudinal side of the stack, said sound pulse being directed at an angle from below the sheet leaving the stack.

2. The apparatus according to claim 1, comprising:

a pull-in roll having a cover formed with an open recess;

said ultrasonic sensor is located in said recess.

3. The apparatus according to claim 2, wherein said cover has a periphery and said recess is formed in said periphery.

4. The apparatus according to claim 1, comprising an additional device for performing a function selected from the group consisting of performing an ultrasonic propagation time measurement by evaluating differential propagation times and performing an ultrasonic propagation time measurement in combination with an ultrasonic phase measurement between an echo from a sheet leaving the stack and an echo from the topmost sheet lying on the stack.

5. The apparatus according to claim 4, wherein said additional device is an electronic device.

6. The apparatus according to claim 1, comprising:

a functional part having a reference web that reflects a sound pulse emitted by said sensor device;

said functional part located in a fixed position between said sensor device and the stack.

7. The apparatus according to claim 6, wherein said functional part is an aligning and guiding element that is pivotally mounted about an axis running at right angles to a sheet transport direction.

8. The apparatus according to claim 7, wherein said functional part is a flap shaft.

9. The apparatus according to claim 7, comprising an additional device for performing a function selected from the group consisting of performing an ultrasonic propagation time measurement by evaluating differential propagation times and performing an ultrasonic propagation time measurement in combination with an ultrasonic phase measurement between an echo from the topmost sheet lying on the stack and an echo from said reference web.

10. The apparatus according to claim 6, comprising an additional device for performing a function selected from the group consisting of performing an ultrasonic propagation time measurement by evaluating differential propagation times and performing an ultrasonic propagation time measurement in combination with an ultrasonic phase measurement between an echo from the topmost sheet lying on the stack and an echo from said reference web.

11. The apparatus according to claim 1, wherein said at least one ultrasonic sensor includes a plurality of ultrasonic sensors that are configured in a manner selected from the group consisting of one beside another and one on top of another.

12. The apparatus according to claim 11, wherein said plurality of said ultrasonic sensors are configured along an imaginary part-circle.

13. The apparatus according to claim 12, wherein:

said plurality of said ultrasonic sensors are configured to emit sound pulses; and said sound pulses can be focused at a location by controlling a phase relationship of signals driving said plurality of said ultrasonic sensors.

14. The apparatus according to claim 11, wherein:

said plurality of said ultrasonic sensors are configured to emit sound pulses; and said sound pulses can be focused at a location by controlling a phase relationship of signals driving said plurality of said ultrasonic sensors.

15. The apparatus according to claim 11, wherein:

said plurality of said ultrasonic sensors are configured to emit sound pulses that can be focused at a location; and by controlling a phase relationship of signals driving said plurality of said ultrasonic sensors, the location can be moved.

16. The apparatus according to claim 15, wherein said location can be moved along a scanning plane.

17. The apparatus according to claim 16, wherein:

the scanning plane runs parallel to the longitudinal side of the stack; and leading edges of the sheets in the stack lie in the scanning plane.

18. The apparatus according to claim 1, wherein said at least one ultrasonic sensor includes a component selected from the group consisting of a transmitter and a receiver pair and a transmitter element which, after outputting a sound pulse, can be switched over to receive the pulse.

19. The apparatus according to claim 1, wherein:

said ultrasonic sensor is configured to transmit a sound pulse that strikes the longitudinal side of the stack such that an echo is returned that is substantially at a right angle with respect to a direction of the sound pulse, as viewed in a plan view of the stack.

20. A method of determining the vertical position of stacked sheets, which comprises:

providing a sheet stack having a longitudinal side;

providing ultrasonic pulses that strike the longitudinal side of the stack at an angle; and performing an ultrasonic propagation time measurement to determine a position of an upper edge of the stack.

21. The method according to claim 20, which comprises providing the sheet stack in a feeder of a sheet-processing machine.

22. The method according to claim 20, wherein the ultrasonic propagation time measurement includes performing a step selected from the group consisting of:

evaluating a differential propagation time between an echo from a sheet leaving the stack and an echo from a topmost sheet lying on the stack; and evaluating a differential propagation time between an echo from a topmost sheet of the stack and an echo of a fixed reference point.

23. The method according to claim 20, which comprises:

loosening a topmost sheet from the stack utilizing a means selected from the group consisting of a gaseous medium and a mechanical device; and wherein the ultrasonic propagation time measurement includes evaluating a differential propagation time between an echo from the loosened topmost sheet and an echo from the stack that is located underneath the loosened sheet.

24. The method according to claim 20, wherein the ultrasonic propagation time measurement includes:

applying ultrasonic pulses to the longitudinal side of the stack such that the pulses strike the stack at an angle; and performing an ultrasonic propagation time measurement in combination with an ultrasonic phase measurement to determine the position of the upper edge of the stack.

25. A method of determining the vertical position of stacked sheets, which comprises:

providing a sheet stack having a longitudinal side;

from a plurality of locations, transmitting and focusing ultrasonic pulses at point on the longitudinal side of the stack; and controlling the transmitted ultrasonic pulses such that the point, at which the transmitted ultrasonic pulses focus, is moved along the longitudinal side of the stack.

26. The method according to claim 25, which comprises controlling the transmitted ultrasonic pulses such that the point, at which the pulses focus, is moved in a line at right angles to leading edges of sheets in the stack.

* * * * *